US010569295B1

(12) United States Patent
Hung

(10) Patent No.: US 10,569,295 B1
(45) Date of Patent: Feb. 25, 2020

(54) CAULKING GUN

(71) Applicant: SIANG SYUAN FU ENTERPRISE CO., LTD., Hemei Township, Changhua County (TW)

(72) Inventor: Hung-Chih Hung, Hemei Township, Changhua County (TW)

(73) Assignee: SIANG SYUAN FU ENTERPRISE CO., LTD., Changhua County (TW)

( * ) Notice: Subject to any disclaimer, the term of this patent is extended or adjusted under 35 U.S.C. 154(b) by 0 days.

(21) Appl. No.: 16/119,112

(22) Filed: Aug. 31, 2018

(51) Int. Cl.
*B05C 17/005* (2006.01)
*B05C 17/01* (2006.01)

(52) U.S. Cl.
CPC ..... *B05C 17/0123* (2013.01)

(58) Field of Classification Search
CPC . B05C 17/01; B05C 17/0123; Y10T 74/1598; Y10T 74/1553
USPC ..... 222/391
See application file for complete search history.

(56) References Cited

U.S. PATENT DOCUMENTS 6,176,398 B1 * 1/2001 Chang ..... B05C 17/01 222/391
6,286,729 B1 * 9/2001 Lin ..... G01F 11/026 222/326
2017/0348724 A1 * 12/2017 Hung ..... B05C 17/00596

FOREIGN PATENT DOCUMENTS

TW M394191 12/2010

* cited by examiner

*Primary Examiner* — Paul R Durand
*Assistant Examiner* — Robert K Nichols, II
(74) *Attorney, Agent, or Firm* — Muncy, Geissler, Olds & Lowe, P.C.

(57) ABSTRACT

A caulking gun includes a gun body, a swinging member, a push rod, driving member and an abutting member. The gun body includes a side wall. The side wall has a penetrated portion. The penetrated portion defines an axial direction. The swinging member is swingably disposed on the gun body. The push rod is axially movably, disposed through the penetrated portion and the swinging member. The driving member is movably disposed in the gun body, and the driving member and the swinging member are located at two sides of the side wall respectively. The push rod is frictionally drivable by the driving member. The abutting member is axially movably disposed through the penetrated portion. The abutting member is disposed circumferentially around the push rod less than 360 degrees. Two ends of the abutting member are axially abuttable against the driving member and the swinging member respectively.

6 Claims, 9 Drawing Sheets

CAULKING GUN

BACKGROUND OF THE INVENTION

Field of the Invention

The present invention relates to a caulking gun.

Description of the Prior Art

A caulking gun is configured to caulk gaps at a corner or between two connected objects, and it is quick and convenient to use. A conventional caulking gun, during operation, has a non-actuating travel of the mechanism for squeezing out the caulking material (that is, the caulking material cannot be squeezed out until the non-actuating travel is finished). In order to avoid the non-actuating travel, there is a caulking gun disclosed as Taiwan patent number M394191 which is characterized that: a driving member of the push rod is kept normally inclined relative to the push rod so as to engaged with the push rod, and a sleeve is slidably disposed on the push rod and abutted between the driving member and a controlling plate. The sleeve is biased against the driving member by pressing the controlling plate so that the driving member is perpendicular to the push rod and the push rod can be pulled backward.

However, during assembling of the conventional caulking gun, the sleeve needs to be sleeved on the push rod first, and then the push rod with the sleeve is assembled to the gun body. The sleeve needs to be disassembled together with the push rod, which is inconvenience for maintenance. In addition, the sleeve is generally made by tube cutting or rod drilling, which greatly increases manufacturing cost.

The present invention is, therefore, arisen to obviate or at least mitigate the above-mentioned disadvantages.

SUMMARY OF THE INVENTION

The main object of the present invention is to provide a caulking gun which has a simple and stable structure without non-actuating travel and is of low cost for manufacturing and easy assembly.

To achieve the above and other objects, the present invention provides a caulking gun, including a gun body, a swinging member, a push rod, a driving member and an abutting member. The gun body includes a side wall which has a penetrating portion, and the penetrating portion defines an axial direction. The swinging member is swingably disposed on the gun body. The push rod is axially movable relative to the gun body and disposed through the penetrating portion and the swinging member. The driving member is movably disposed within the gun body, and the driving member and the swinging member are located at two sides of the side wall respectively. The push rod is frictionally drivable by the driving member. The abutting member is axially movably disposed through the penetrating portion, and the abutting member is disposed circumferentially around the push rod less than 360 degrees. Two ends of the abutting member are axially abuttable against the driving member and the swinging member respectively.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
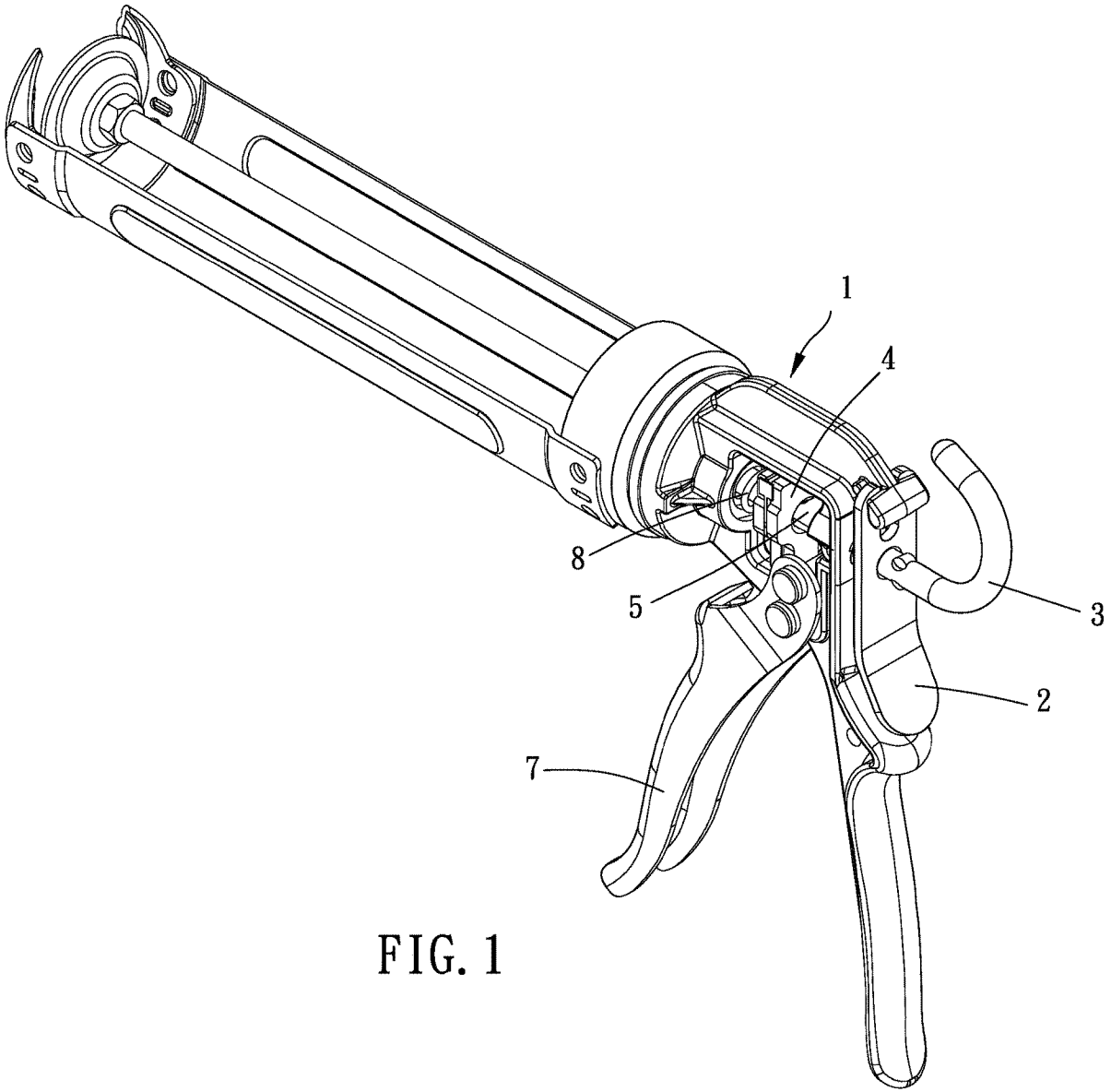
FIG. 1 is a stereogram of a preferable embodiment of the present invention.
Figure 2:
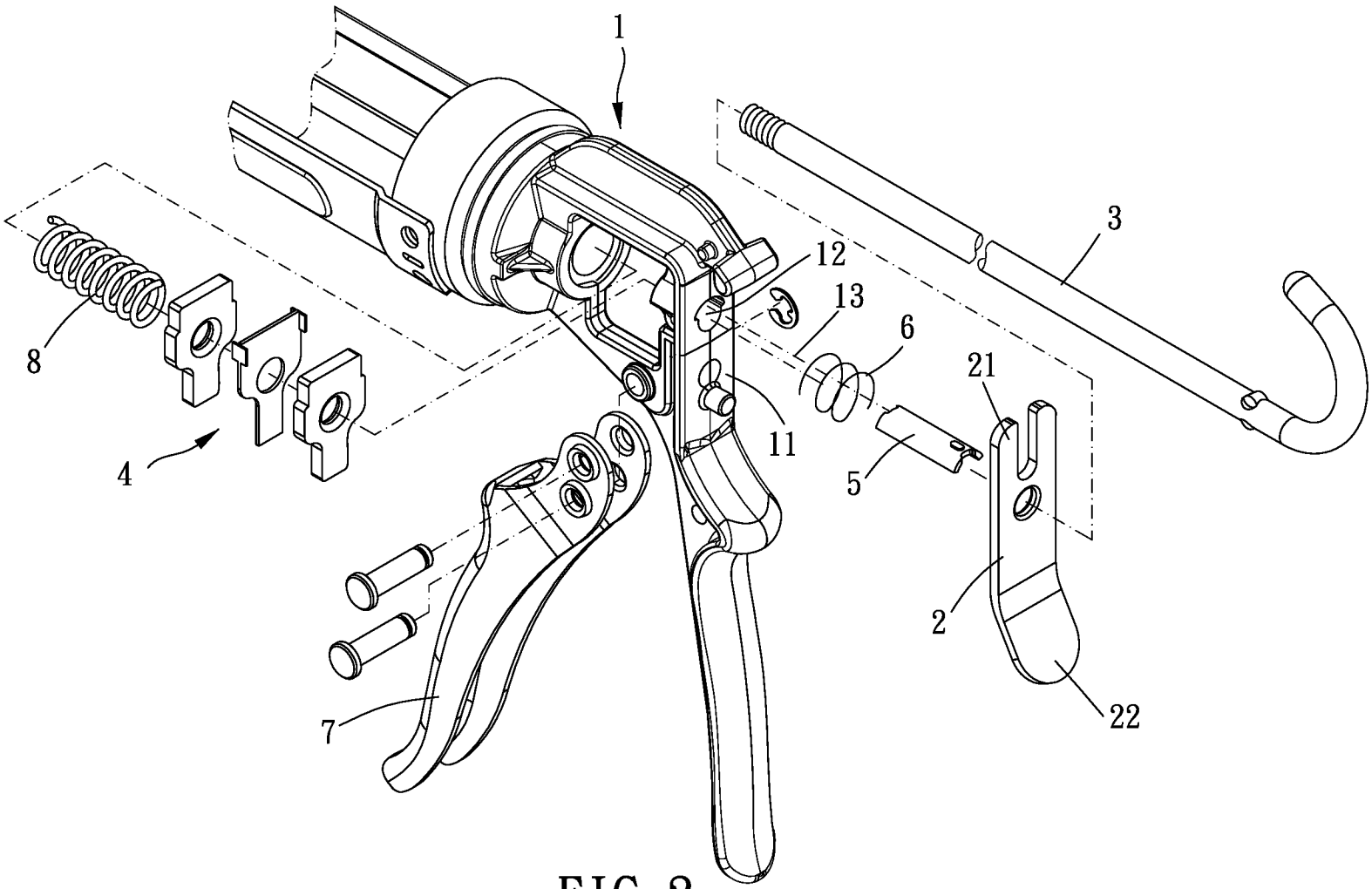
FIG. 2 is a breakdown drawing of a preferable embodiment of the present invention.

Please refer to FIGS. 1 to 9 for a preferable embodiment of the present invention. A caulking gun of the present invention includes a gun body 1, a swinging member 2, a push rod 3, a driving member 4 and an abutting member 5.

The gun body 1 includes a side wall 11 which has a penetrating portion 12, and the penetrating portion 12 defines an axial direction 13.

The swinging member 2 is swingably disposed on the gun body 1.

The push rod 3 is axially movable relative to the gun body 1 and disposed through the penetrating portion 12 and the swinging member 2.

Figure 5:
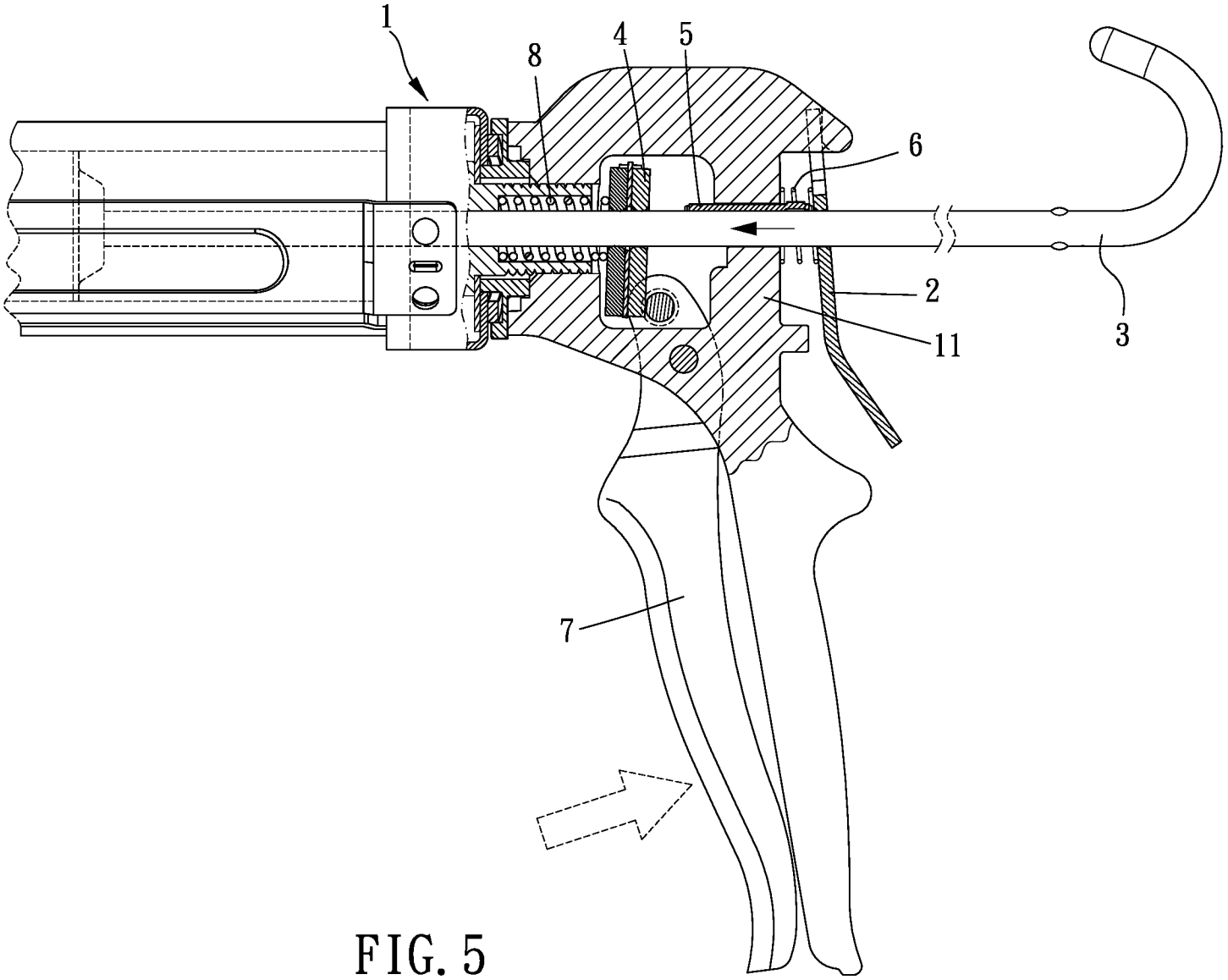
FIGS. 5 to 7 are schematic diagrams of a preferable embodiment of the present invention in operation.
Figure 6:
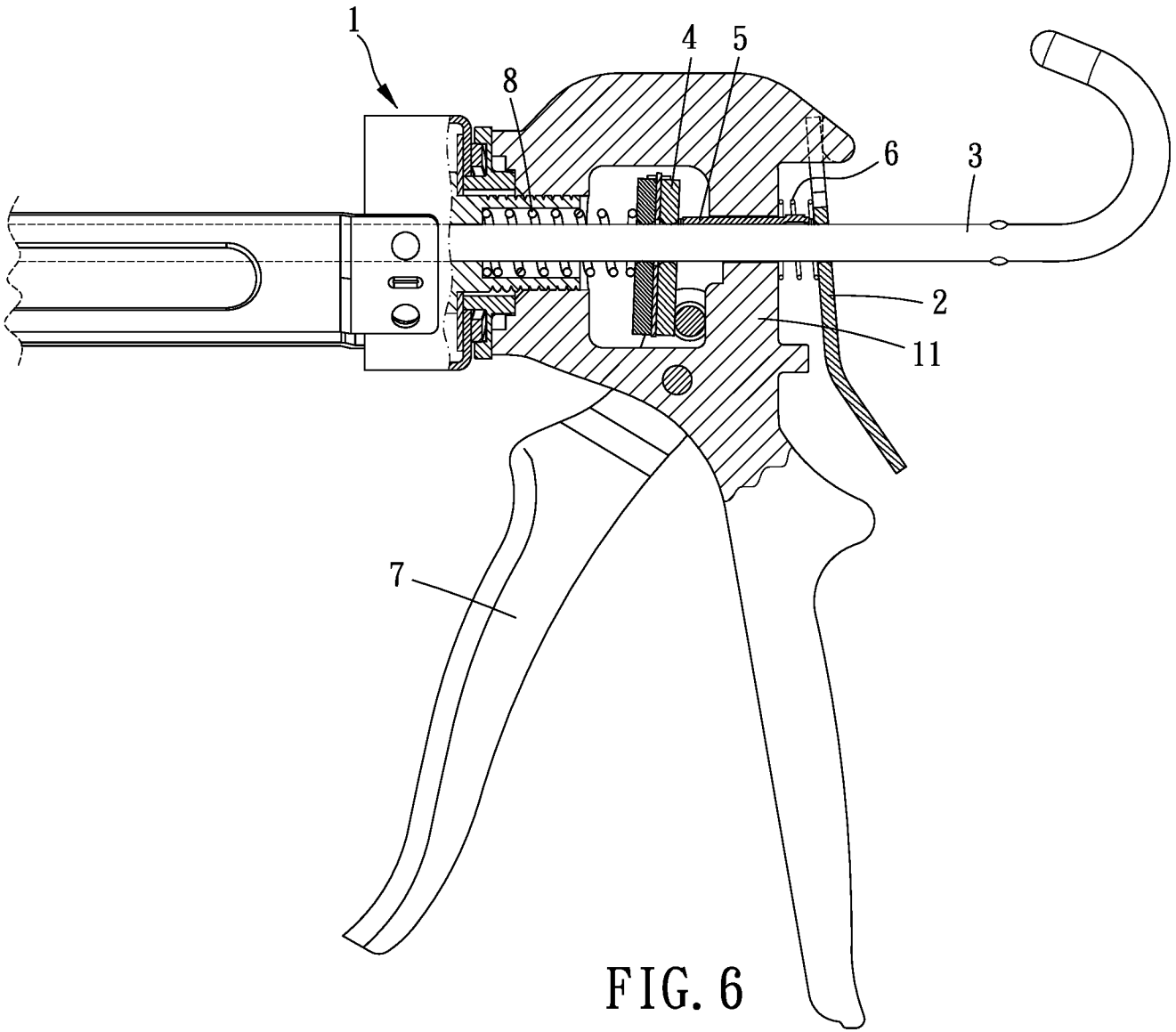

The driving member 4 is movably disposed within the gun body 1, and the driving member 4 and the swinging member 2 are located at two sides of the side wall 11 respectively. The push rod 3 is frictionally drivable by the driving member 4. In this embodiment, the gun body 1 further includes a pressing lever 7 pivoted on the gun body 1 and a returning spring 8. The returning spring 8 is disposed between the driving member 4 and the gun body 1 so that the driving member 4 has a tendency to move toward the swinging member 2. An end of the pressing lever 7 is swingably abuttable against the driving member 4. The driving member 4 is biased between the returning spring 8 and the pressing lever 7 and normally inclined relative to the push rod 3. A portion of the driving member 4 above the push rod 3 is inclined toward the side wall 11, and a portion of the driving member 4 below the push rod 3 is inclined toward the returning spring 8 so that the driving member 4 is normally frictionally engaged with the push rod 3 and the caulking gun has no non-actuating travel. The driving member 4 and the push rod 3 can be moved at the same time without any non-actuating travel when the pressing lever 7 is pressed (as shown in FIG. 5).

Figure 7:
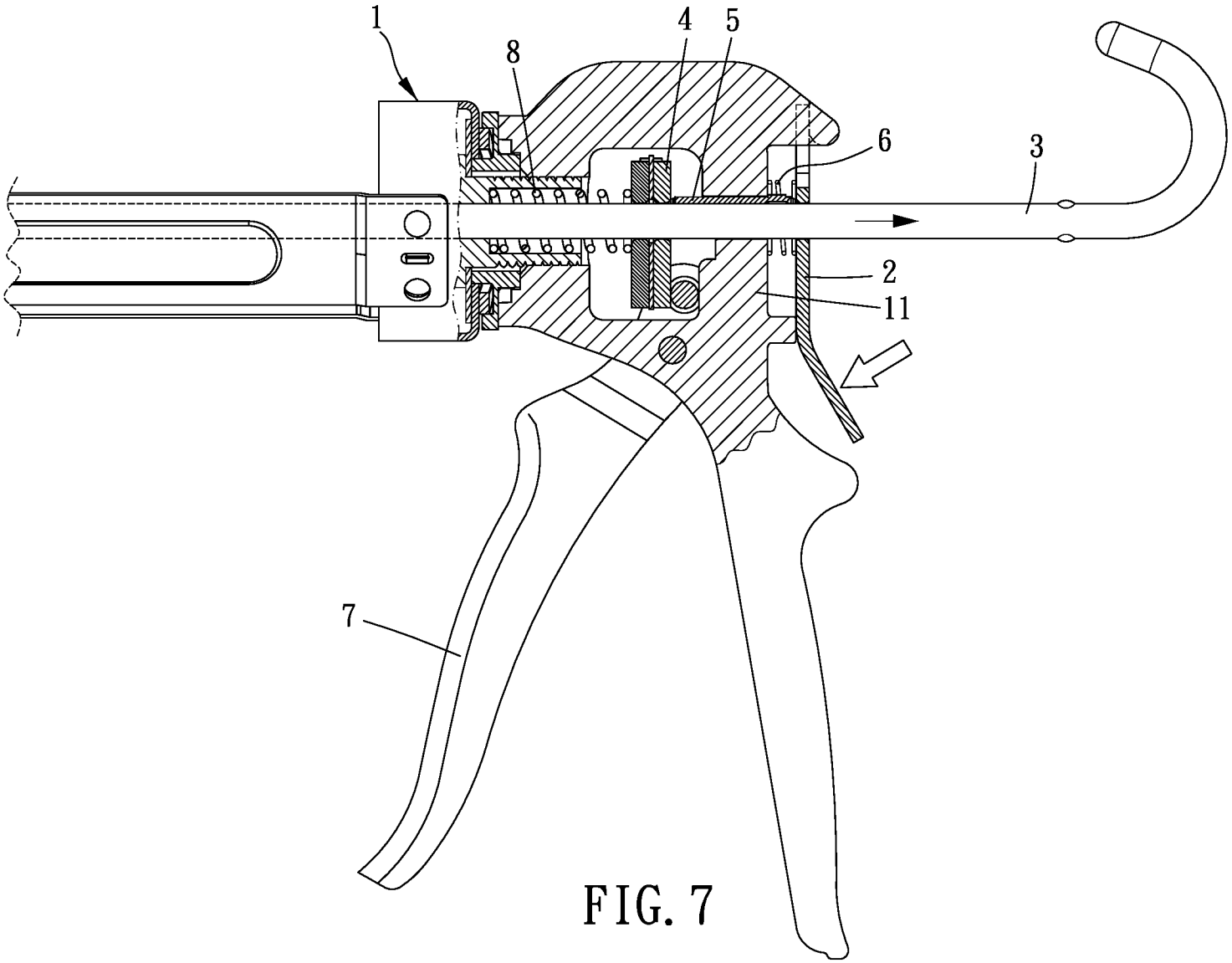

The abutting member 5 is axially movably disposed through the penetrating portion 12, and the abutting member 5 is disposed circumferentially around the push rod 3 less than 360 degrees. Two ends of the abutting member 5 are axially abuttable against the driving member 4 and the swinging member 2 respectively. When the swinging member 2 is pressed, the abutting member 5 is driven to push the driving member 4 (as shown in FIG. 7) to be perpendicular to the push rod 3 so that frictional engagement of the driving member 4 and the push rod 3 is released and the push rod 3 is freely movable. In this embodiment, the gun body 1 further includes an elastic member 6. The elastic member 6 is disposed between the side wall 11 and the swinging member 2 so that the swinging member 2 has a tendency to move away from the abutting member 5. The swinging member 2 is biased away from the gun body 1 when the swinging member 2 is not pressed, which is convenience in operation.

Specifically, the abutting member 5 is disposed circumferentially around the push rod 3 less than 360 degrees so that the abutting member 5 can be directly assembled into the penetrating portion 12 without pre-assembling of the abutting member 5 to the push rod 3. When the abutting member 5 is disassembled and replaced, it does not need to disassemble the push rod 3, and the abutting member 5 can be disassembled from the side near the side wall 11, which is convenience for assembly and disassembly.

Figure 4:
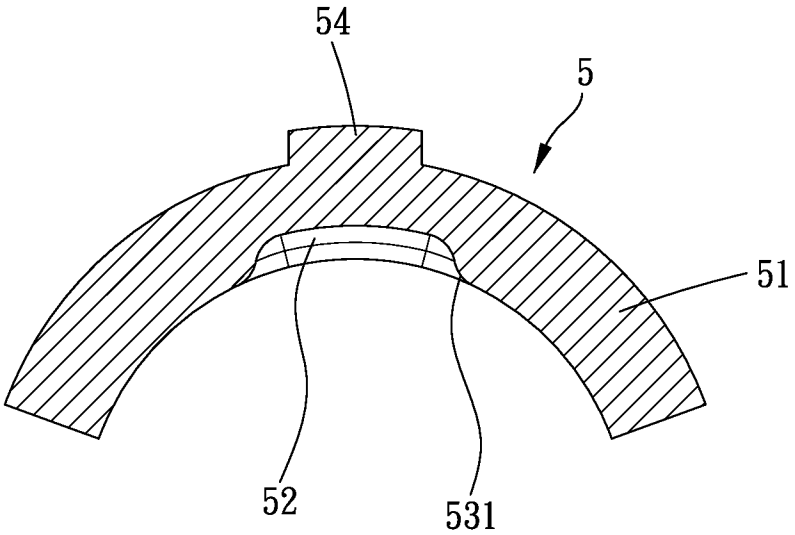
FIG. 4 is a partial enlarged cross sectional view of a preferable embodiment of the present invention.

In this embodiment, the abutting member 5 is an arcuate plate circumferentially extending less than 360 degrees and has a section 51 which is arcuate and unclosed in a circumferential direction (as shown in FIG. 4). The abutting member 5 is abutted radially against the push rod 3. The abutting member 5 is stable and is slidable relative to the push rod 3. The abutting member 5 may be formed, by stamping, of a plate into an arcuate plate so as to reduce manufacturing cost. In other embodiments, the abutting member 5 may be a flat plate. In other embodiments, an additional member may be associated with the abutting member to surround the push rod. For example, an end of the abutting member has a covering portion which is pivotable to or engageable with the abutting member, and the covering portion is detachably covered on the push rod after the abutting member is assembled to the penetrating portion. The covering portion is disengaged or opened for disassembly of the abutting member. As a result, it is convenience for assembly/disassembly.

Figure 3:
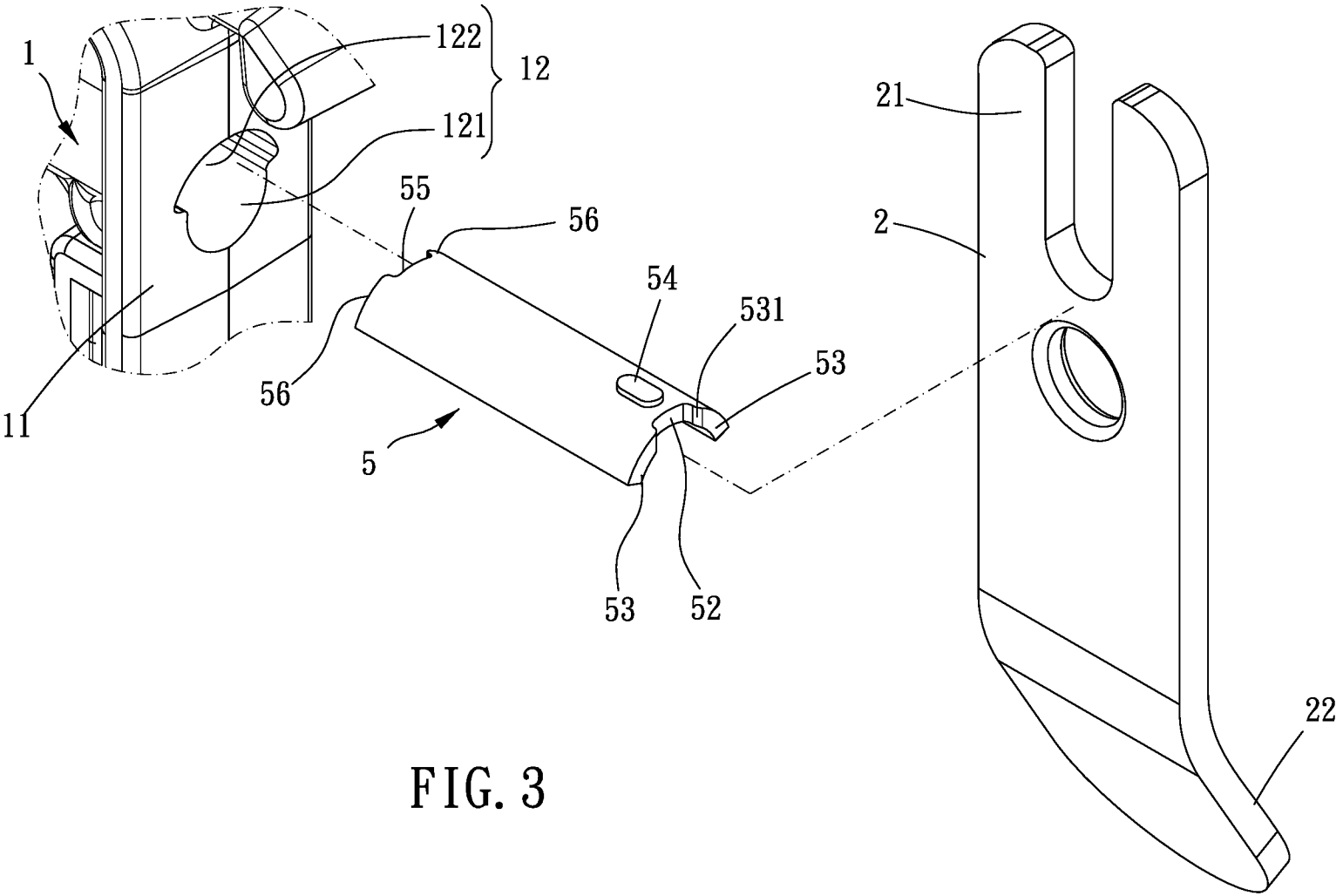
FIG. 3 is a partial enlarged breakdown drawing of a preferable embodiment of the present invention.
Figure 8:
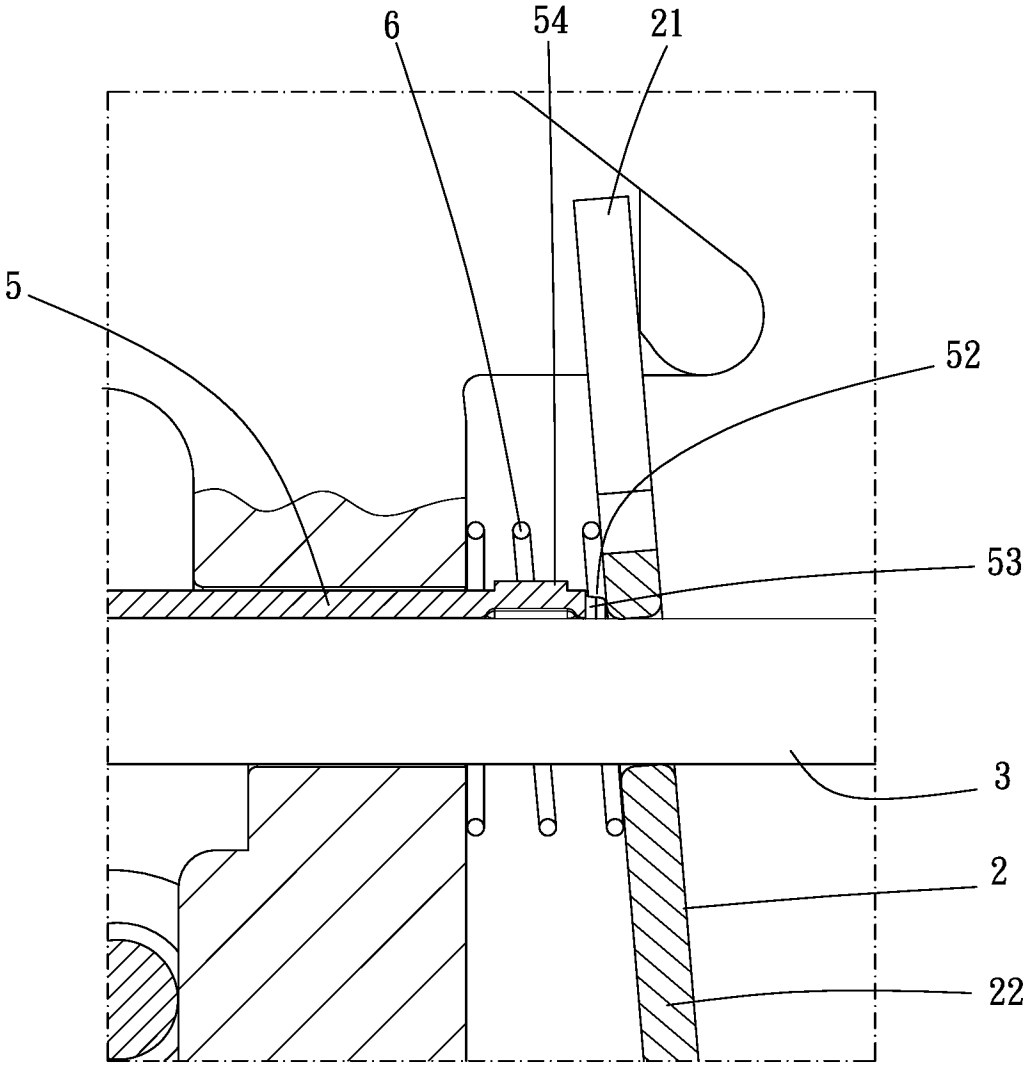
FIG. 8 is a partial enlargement of FIG. 6.
Figure 9:
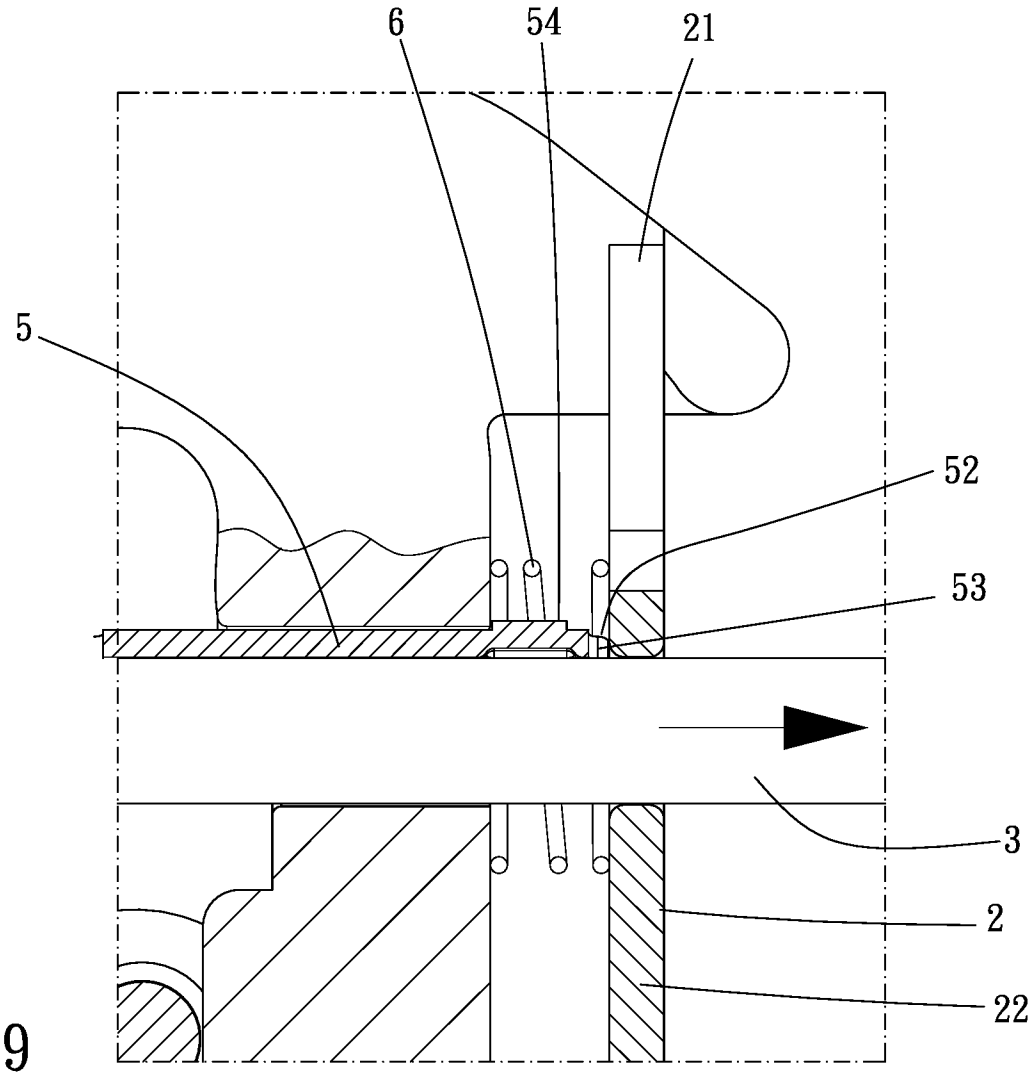
FIG. 9 is a partial enlargement of FIG. 7.

As shown in FIGS. 8 and 3, the abutting member 5 preferably has a first notch 52 and two first abutting portions 53 facing the swinging member 2. The first notch 52 is disposed between the two first abutting portions 53, and the two first abutting portions 53 are abuttable axially against the swinging member 2. The first notch 52 is intermediately disposed on a distal end of the abutting member 5. As viewed in a radial direction, the first notch 52 is inverted-U shaped, and each of the two first abutting portions 53 has a rounded corner edge 531 adjacent the first notch 52. In the beginning of the returning spring 8 moving the driving member 4 and the abutting member 5 toward the swinging member 2, the abutting member 5 does not contact the swinging member 2 immediately because of the first notch 52. After the abutting member 5 moves a certain distance, the two first abutting portions 53 can be abutted against the swinging member 2. The two rounded corner edges 531 provide higher tolerance of effective stable contacts with the swinging member 2, and prevent the abutting member 5 from a counterforce of the swinging member 2 which pushes the driving member 4 toward the returning spring 8 and results in the non-actuating travel. Therefore, the first notch 52 and the two first abutting portions 53 provide higher tolerance of an axial length of the abutting member 5 so as to effectively reduce manufacturing cost of the abutting member 5.

In this embodiment, an end near the swinging member 2 of a convex of the abutting member 5 has a projection 54 projecting radially away from the push rod 1, and the projection 54 is abuttable axially against the side wall 11 so as to prevent the abutting member 5 from excessively moving toward the driving member 4 when the swinging member 2 is pressed.

Preferably, the abutting member 5 has a second notch 55 and two second abutting portions 56 facing the driving member 4. The second notch 55 is disposed between the two second abutting portions 56, and the two second abutting portions 53 are abuttable axially against the driving member 4. Therefore, the second notch 55 and the two second abutting portions 56 provide higher tolerance of the axial length of the abutting member 5 and effectively reduce the manufacturing cost of the abutting member 5.

In this embodiment, the penetrating portion 12 includes a circular hole 121 and an arced hole 122 which are communicated with each other. A radius of curvature of the arced hole 122 is larger than that of the circular hole 121, and a radian of the abutting member 5 corresponds to the arced hole 122 and the abutting member 5 is disposed through the arced hole 122 so as to prevent the abutting member 5 from swaying relative to the push rod 3 or moving circumferentially. In other embodiments, the penetrating portion may be other shape according to the shapes of the abutting member and the push rod. The swinging member 2 has a pivoting end 21 mounted on the gun body 1 and a free end 22, and the arced hole 122 is located between the circular hole 121 and the pivoting end 21 so as to reduce a required length of the abutting member 5 for low cost.

In summary, the caulking gun of this invention has a simple and stable structure without non-actuate travel and is of low cost for manufacturing and easy assembly.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A caulking gun, including:

a gun body, including a side wall which has a penetrating portion, the penetrating portion defining an axial direction;

a swinging member, being swingably disposed on the gun body;

a push rod, being axially movable relative to the gun body and disposed through the penetrating portion and the swinging member;

a driving member, being movably disposed within the gun body, and the driving member and the swinging member being located at two sides of the side wall respectively, the push rod being frictionally drivable by the driving member;

an abutting member, being axially movably disposed through the penetrating portion, the abutting member being disposed circumferentially around the push rod less than 360 degrees, two ends of the abutting member are axially abuttable against the driving member and the swinging member respectively;

wherein the abutting member is an arcuate plate circumferentially extending less than 360 degrees, and the abutting member is abutted radially against the push rod;

wherein the abutting member has a first notch and two first abutting portions facing the swinging member, the first notch is disposed between the two first abutting portions, and the two first abutting portions are abuttable axially against the swinging member wherein the first notch is intermediately disposed on a distal end of the abutting member, the first notch is inverted-U shaped, and each of the two first abutting portions has a rounded corner edge adjacent the first notch;

wherein an end near the swinging member of a convex surface of the abutting member has a projection projecting radially away from the push rod, and the projection is abuttable axially against the side wall.

2. The caulking gun of claim 1, wherein the abutting member further has a second notch and two second abutting portions facing the driving member, the second notch is disposed between the two second abutting portions, and the two second abutting portions are abuttable axially against the driving member.

3. The caulking gun of claim 1, further including an elastic member, wherein the elastic member is disposed between the side wall and the swinging member so that the swinging member has a tendency to move away from the abutting member.

4. The caulking gun of claim 3, further including a pressing lever pivoted on the gun body and a returning spring, wherein the returning spring is disposed between the driving member and the gun body so that the driving member has a tendency to move toward the swinging member, and an end of the pressing lever is swingably abuttable against the driving member.

5. A caulking gun, comprising:

a gun body, including a side wall which has a penetrating portion, the penetrating portion defining an axial direction;

a swinging member, being swingably disposed on the gun body;

a push rod, being axially movable relative to the gun body and disposed through the penetrating portion and the swinging member;

a driving member, being movably disposed within the gun body, and the driving member and the swinging member being located at two sides of the side wall respectively, the push rod being frictionally drivable by the driving member;

an abutting member, being axially movably disposed through the penetrating portion, the abutting member being disposed circumferentially around the push rod less than 360 degrees, two ends of the abutting member are axially abuttable against the driving member and the swinging member respectively;

wherein the penetrating portion includes a circular hole and an arced hole which are communicated with each other, a radius of curvature of the arced hole is larger than that of the circular hole, and a radian of the abutting member corresponds to the arced hole and the abutting member is disposed through the arced hole.

6. The caulking gun of claim 5, wherein the swinging member has a pivoting end mounted on the gun body and a free end, and the arced hole is located between the circular hole and the pivoting end.

* * * * *